US006236321B1

(12) United States Patent
Troost, IV

(10) Patent No.: US 6,236,321 B1
(45) Date of Patent: May 22, 2001

(54) CLEAN OUT ALERT FOR WATER HEATERS

(75) Inventor: Henry E. Troost, IV, River Falls, WI (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 09/696,143

(22) Filed: Oct. 25, 2000

(51) Int. Cl.[7] ..... G08B 17/00

(52) U.S. Cl. ..... 340/588; 340/589; 340/592; 340/573.6; 126/116 A; 126/116 R; 126/351

(58) Field of Search ..... 340/588, 589, 340/592, 573.6; 126/116 A, 110 R, 351

(56) References Cited

U.S. PATENT DOCUMENTS

| | | | | |
|---|---|---|---|---|
| 3,834,357 | | 9/1974 | Kaczmarek et al. | 122/504 |
| 3,948,439 | | 4/1976 | Heeger | 236/21 B |
| 4,445,638 | | 5/1984 | Connell et al. | 237/812 |
| 5,023,432 | | 6/1991 | Boykin et al. | 219/497 |
| 5,531,214 | | 7/1996 | Cheek | 126/361 |
| 5,571,007 | * | 11/1996 | Ishiguro et al. | 431/13 |
| 5,586,719 | | 12/1996 | Katchka | 236/21 B |
| 5,590,642 | * | 1/1997 | Borgeson et al. | 126/116 A |
| 5,797,358 | | 8/1998 | Brandt et al. | 122/448.1 |
| 5,836,511 | | 11/1998 | Gilmour | 236/21 R |
| 5,921,207 | | 7/1999 | DiSalvo et al. | 122/388 |
| 6,053,130 | | 4/2000 | Shellenberger | 122/504 |

* cited by examiner

*Primary Examiner*—Daniel J. Wu
*Assistant Examiner*—Tai T. Nguyen
(74) *Attorney, Agent, or Firm*—Charles L. Rubow

(57) ABSTRACT

An apparatus and method for determining and communicating a need for water heater clean out based on scale deposit buildup is disclosed in which a sensed increase in average reheat time is employed as a measure of deposit buildup and to initiate a clean out alert.

32 Claims, 2 Drawing Sheets

CLEAN OUT ALERT FOR WATER HEATERS

BACKGROUND OF THE INVENTION

I. Field of the Invention

The present invention deals generally with liquid heating systems typified by water heating systems. More particularly, the invention involves a clean out alerting system for scale buildup in water heating systems which derives from changes in recovery heating efficiencies in such systems. A decrease in efficiency, it has been learned, may be noted based on a percentage increase in the average time required to heat the water from the temperature at which the system calls for heat to the set point temperature, i.e., the duration of the ON portion of the cycle.

II. Related Art

Hot water tanks, boilers and the like have long provided sources of commercial hot water for a variety of purposes. These devices may be tankless but typically include a vessel for containing a volume of water to be heated and contained within a metal outer tank structure. Heating may be electrical, using one or more heating elements geometrically arranged and immersed within the volume of water, or gas heated, including a burner system and one or more heat exchangers. The tank or similar device is suitably attached to a source of make up water and one or more external devices for using the heated water such as faucets, radiators or other heat exchangers or the like.

The systems are thermostatically controlled about a manually adjustable set point calling for heat when the sensed water temperature falls a preset amount below the set point temperature and shutting off the energy input when the set point temperature is regained. This sequence is known as a heating cycle and is repeated many thousands of times over the life of the heating vessel.

Regardless of the type of heating unit involved, tank, tankless, boiler, etc., mineral deposits called scale form during the water heating process. These deposits form on the hot heat exchanger surfaces of the unit and create an insulating layer which builds and reduces heat transfer efficiency or decreases dissipation of input energy which also causes the temperature of the outside metal surface to increase. Continued buildup further reduces heat transfer and further increases the metal heat level. In this manner operating costs increase due to the lower heat transfer efficiency and the life of the heating unit decreases due to overheating. In some high duty applications which require large amounts of hot water such as restaurants, laundries, hotels and motels, etc., water heaters develop deposits quickly, causing short product life and thus frequent heater replacement.

The problem of scale buildup has been traditionally addressed by either of two approaches, i.e., by carrying out periodic cleaning on a regular basis or by adding water treatment equipment to the system. The first approach probably will not mimic or reflect properly the actual cleaning needs of the system and relies on guesswork. If the time between cleanings is too short, cleaning will be undertaken too often and thus not be cost effective. If the interval is too long, appliance life and efficiency are again sacrificed. The time variable nature of water use also works to thwart the desirability of this approach. The second solution is even more impractical for all but the largest industrial applications owing to the high cost of water treatment solutions.

In the past commercial water heater controls were rather unsophisticated ON-OFF electromechanical devices that turned a burner or other energy source on when a thermostat called for heat following a drop in temperature and turned the energy source off when the water temperature reached the set point temperature. More recently, the introduction of microprocessor based electronically controlled technology has enabled the sophistication of such control systems to be greatly expanded. This includes the sensing and the integrating of information pertaining to additional operating characteristics. It would be desirable if this potential could be harnessed to provide a more accurate estimate of the amount of accumulated scale in a water heater, boiler, or other such vessel.

It is known from U.S. Pat. No. 4,445,638 to measure the rate of rise of the temperature of boiler water to identify the existence of a low water condition perceived as an abnormally rapid rate of water temperature rise. This information is used to insure that the system operates in a proper rust-inhibiting mode and can be used to shut the system down if a preset minimum heating or recovery time limit is not reached. It is further known to incorporate a microprocessor in water heater control systems for a variety of reasons, for example, U.S. Pat. No. 5,797,358 depicts microprocessor control of temperature set point programming and burner control that prevents operation in the presence of detected unsafe conditions.

SUMMARY OF THE INVENTION

The present invention provides a needed solution to the long-standing problems associated with scale buildup in water heaters that provides an accurate measure of scale buildup effects on heat transfer in liquid heating vessels and alerts the operator of a need for scale clean out. The concept involves monitoring the average time rate of temperature change during the recovery or reheat phase of each heating cycle of the apparatus, i.e., from the time the control system calls for heat until the temperature reaches the control set point temperature and the heat input is turned off. An increase in the average time required to reheat or for the unit to recover to a given temperature of course indicates lower efficiency and scale buildup. A selected percentage increase may be used to trigger a clean out alert to those interested.

For the purposes of this application, the term "heating cycle" or "cycle" refers to a heating/cooling cycle consisting of a heat or reheat phase in which the associated source of heat is on and a use or cool-down phase during which the temperature drops a sufficient amount to trigger another reheat phase due to hot liquid usage and consequent make up by cooler liquid or from system heat loss. Also, the term "reheat" as used herein may also refer to a startup cycle or initial heating phase.

Since the rate of rise is affected by factors other than just scale it is necessary to use an averaging technique to neutralize the effects (water temperature, gas pressure, water usage, rate, etc.) based on a set of reheat rates based on monitoring a number of reheat rates as the system cycles a source of heat on and off based on thermostat or similar control. Thus, a number of consecutive or intermittent cycles are monitored to determine a set which becomes the then current effective average reheat time. Any suitable number of 2 or more reheat phases which allows accurate tracking of a particular system and application can be used to define a set. As indicated, these may be consecutive or intermittent (i.e., based on any desired dedicated function stored in memory such as every other or every third cycle, or even a random selection process). Considerations including application experience, make up water hardness and types of minerals in the water (for water heaters), types and composition of vessel heat exchangers may also be considered. Consistencies between cycles or heating phases can also be noted by the microprocessor and stored in memory and considered in determining what constitutes a proper set of reheat phases allowing the system to learn and become a "smart" system based on past history. In addition, the functions determining the sampling of heating phases for a set may be one that is programmed and stored in a programmable memory of a microprocessor associated with the alerting system of the invention.

Thus the system is preferably microprocessor controlled with the ability to utilize sensor data in a variety of ways. Generally, in one mode the system is utilized to measure and store the rate of rise for a number of successive heating cycles and when a preselected empirically determined sufficient, such as to constitute a representative average number of such cycles are stored, e.g. 20, the microprocessor control averages the rate of rise and records this average. The first such average value is stored as a baseline or an initiation point. The control continues to monitor ensuing heat cycles averaging each successive group or set of 20 cycles and compares the results to the first stored or baseline value. When the average temperature rise of a given group of cycles has increased by a predetermined amount, usually between 5% and 15%, possibly 10%, a signal may be sent by the controller to an output device to indicate the need to inspect the water heating appliance and clean out accumulated scale. This signal output could be a simple light on the control or appliance which could be part of the control or may be provided as a separate signal alert. It could also be sent through any number of monitoring systems such as via computer network, a dial-up modem to the service company, remote alarms and others.

It will be recognized that both the sufficient cycle number and percentage change used to trigger a clean out alert may vary greatly from one species of heating vessel to another and even among vessels of the same species. While generally consecutive cycle heating phases are sensed, in some cases, every other cycle, or every third cycle, etc., may be tapped for averaging. Sampling may be based on a random function so long as accurate clean out guidance is provided. Older devices may require different treatment. The microprocessor may be programmed to compensate for changes in set point or water or liquid usage, if desired. The rate of temperature rise may be measured between specific predetermined temperatures as indicated by the temperature indicator.

BRIEF DESCRIPTION OF THE DRAWINGS

In the drawings wherein like numerals depict like parts throughout the same.

DETAILED DESCRIPTION

Although the application of the invention illustrated in the detailed embodiment herein focuses on a conventional water-heating appliance, as one skilled in the art may have recognized, this is clearly not meant to be limiting in any manner as other types of water heaters including residential and commercial boilers may take advantage of the invention along with many other species of liquid processing equipment in which sediment and scale accumulation causes deterioration in the performance of the heat transfer system. The invention then is not limited to the heating of water but can be applied to the control systems of units for the heating of any fluid in any vessel type in which the accumulation of the deposits on heat exchange surfaces poses a problem. Hence, the terms "vessel" and "appliance or unit" are used in a universal sense which includes tankless systems. With this in mind, a detailed description of one preferred embodiment will be next undertaken.

Figure 1:
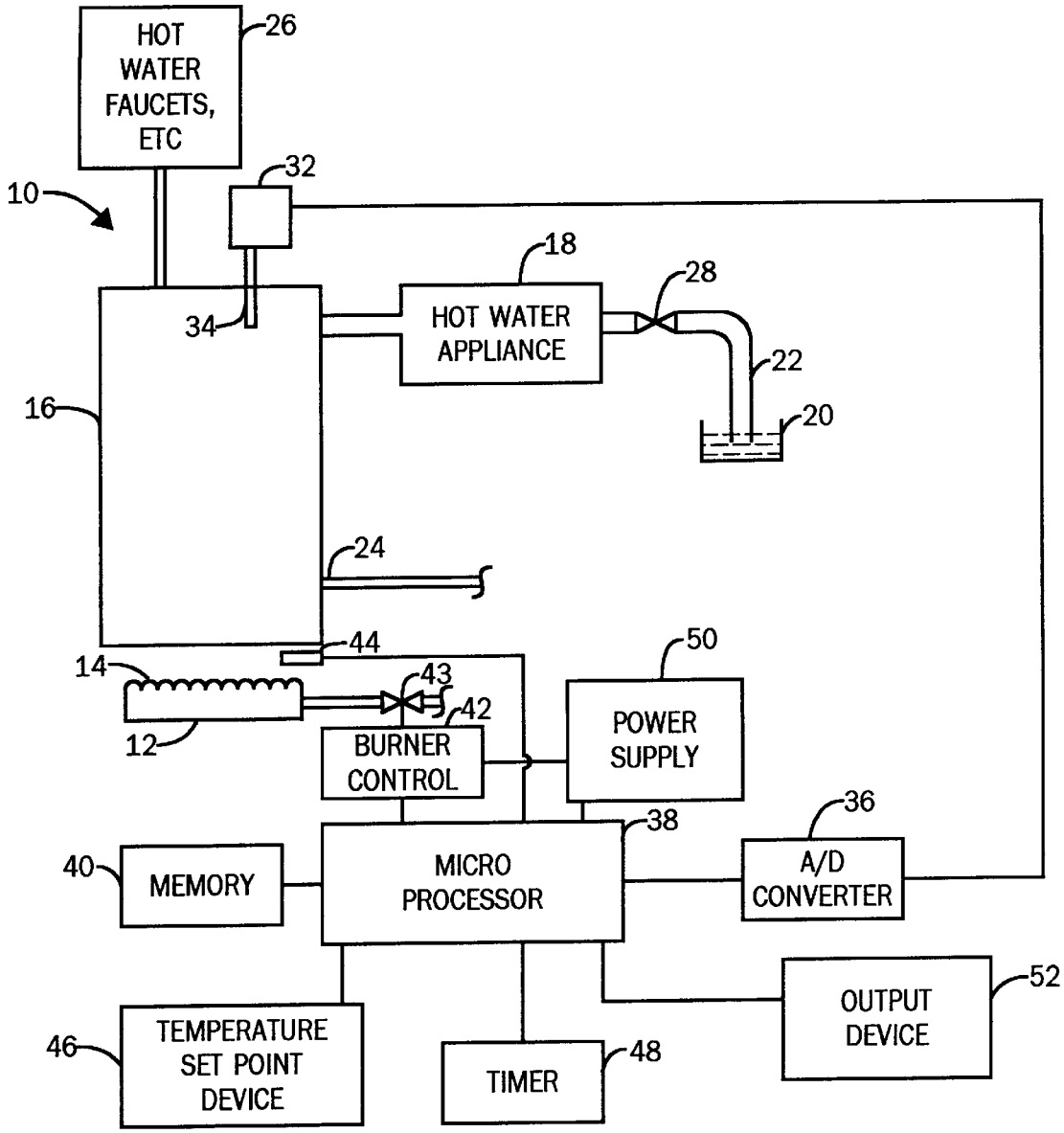
FIG. 1 is a simplified schematic drawing of a water heating appliance utilizing the alerting system of the invention.

The control system depicted in the simplified schematic of FIG. 1 is shown controlling a water heating appliance generally at 10 having a conventional burner 12 which applies a flame 14 to water heater heat exchanger 16 in which water (not shown) is heated. A hot water heater utilizing appliance 18 which may be a washing device 18 is connected by an outlet pipe 22 suitably valved at 28 to a drain sump 20. Make-up water is supplied through conduit 24 which is normally connected to a conventional water supply system in a well known manner. Hot water faucets typically associated with a hot water heater are indicated collectively by 26.

A thermostatic control device 32 (an associated temperature set point device is depicted by box 46) which includes a temperature sensing probe 34 is provided and connected via an A/D converter 36 to convert the analog temperature signal to a digital signal which information can be processed by microprocessor 38 which is shown with associated memory at 40. The microprocessor, of course, provides the necessary control and calculating power for the system. A conventional flame sensor 44 and burner control 42 with associated fuel valve 43 which operate in a well known or conventional manner are also depicted. The temperature control set point was previously indicated as represented by 46, an electronic timing device or clock which may be within the microprocessor, is shown at 48 and a power supply is represented by 50. The power supply 50 is meant to represent any step down transformer, battery or battery backup system, or other power source which might be connected to the control system. An output device is depicted by the box 52. The box 52, of course, is meant to represent any connected output device including audible or visual alarms, printing devices, a connection to any of a number of monitoring systems such as a computer network, dial-up modem to a service company, remote alarms and others. The output device 50 may even be connected to a system shut off control if desired.

A microprocessor, of course, is a powerful tool and represents the central controlling entity for the operation of the system providing calculating power and associated memory which provide timing and switching signals to operate the heating and circulation systems in addition to linking the timing function of the clock with the digitized temperature signal to calculate the temperature rise as a function of time in degrees per minute or other convenient measure. The microprocessor can be programmed to determine and control the sampling rate for the calculations, the counting of samples, averaging accumulated samples, comparing with baseline, etc. Information can be stored and later used. Historic trends can be used to modify subsequent operating characteristics. It will be recognized that the microprocessor control 38 shown in the drawing may actually represent a plurality of discreet devices or components that are supplied as integral parts of other system elements or components such as control valves, thermostatic controls and output devices. The drawing is intended to be simply a schematic representation of function and not to illustrate any particular physical embodiment.

The temperature sensing probe 34 may be a separate component in the form of a NTC (negative temperature co-efficient) thermister or a PTC (positive temperature co-efficient) thermister or other device which provides an electronically sensible temperature reaction. The set point device 46 is shown as being connected directly to the microprocessor indicating a digital device but an analog potentiometer or other device may be used to provide information through an associated A/D converter to the microprocessor as well.

Figure 2:
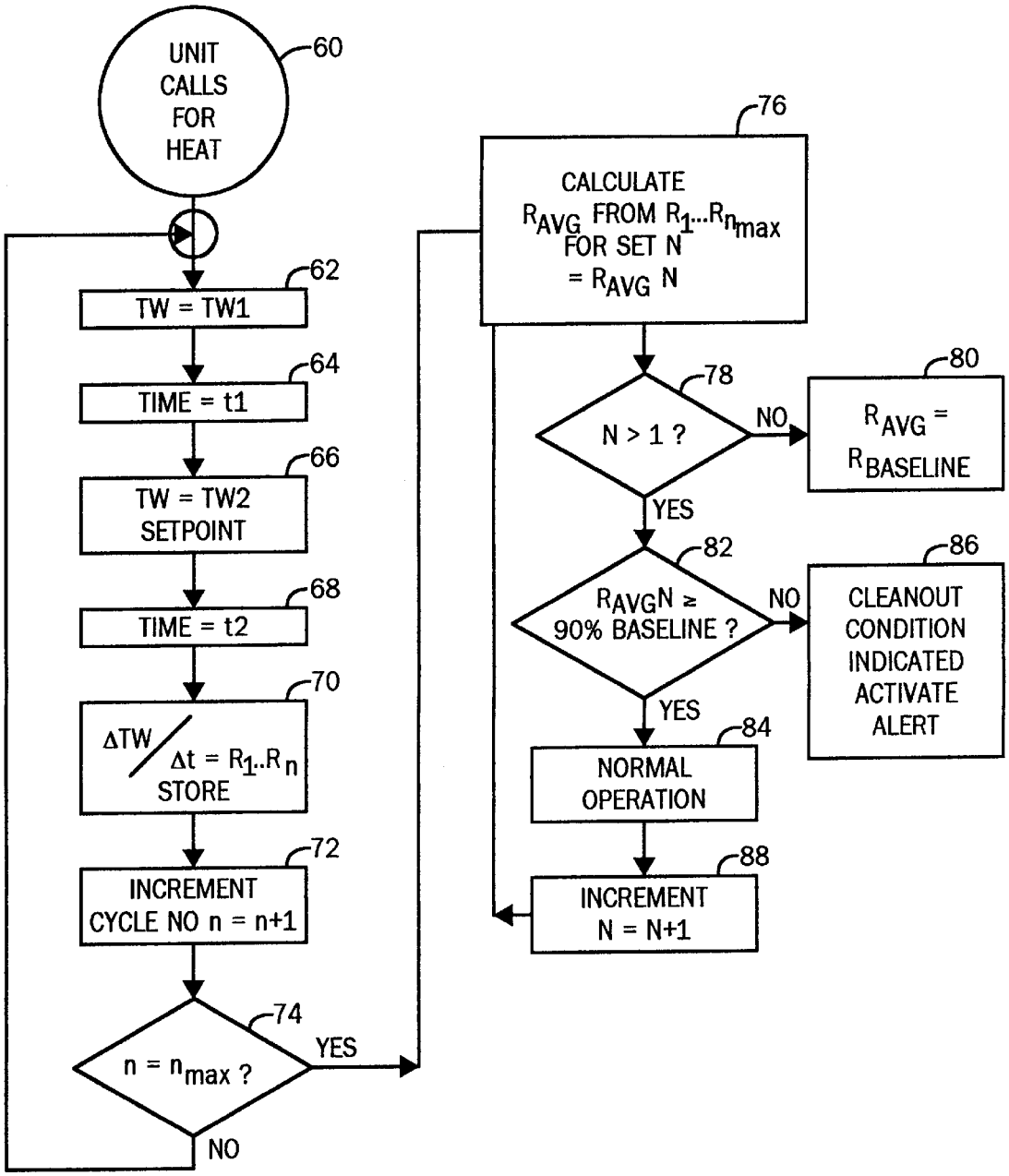
FIG. 2 is a flow chart depicting a preferred mode of operating the alerting system of FIG. 1.

The operation of the system disclosed in FIG. 1 relies on thermostatic control. The temperature sensor 34 transmits through 32, a signal indicative of the temperature of the heated water in the heat exchanger 16 which, when digitized at 36 and compared with the set point input 46, indicates that a rise in temperature is in order and the unit calls for heat at 60 (FIG. 2). The burner control 42 opens valve 43 to supply fuel to burner 12 and flame 14 is confirmed by sensor 44. Heat is thereafter provided until the sensed water temperature reaches the set point temperature as determined by a microprocessor algorithm known to those skilled in the art. At set point, the valve 43 is shut ending the ON or reheat phase of the cycle.

FIG. 2 depicts a flow chart of the clean out alert system which illustrates one mode of operation. The chart begins with the unit calling for heat at 60. The temperature of the water at this juncture is noted as TW1 and is stored in memory. A timer is started by the microprocessor at the same time a signal is sent to turn on the burner. The time is noted and stored as t1 at 64. When the unit shuts off at set point as determined by the microprocessor, the water temperature is again noted and stored as TW2 at 66 at time t2 which is stored at 68. The rate of rise is stored as a calculated value R at 70. The cycle number count associated with the ON portion just finished is incremented by one at 72 and compared with a number $n_{max}$ which represents the number of cycles in a set, then being used in averaging the temperature rise data nominally 20 cycles at 74. When n equals $n_{max}$, an averaging operation is carried out at 76 by summing $R_1$ plus $R_2 \ldots R_n$, equals $n_{max}$ and dividing by $n_{max}$.

This results in $R_{avg}N$ where N represents the number of the set of cycles having been averaged. The number N is compared with 1 to determine whether it represents the first set or a subsequent set at 78. If N equals 1, $R_{avg}1$ is stored as the baseline value at 80 and if N is greater than 1, it is compared with predetermined function of the stored baseline value, such as 0.9 (baseline) as shown at 82. It will be seen that as the efficiency of the heating phase degrades, the value R decreases in relation to baseline as it measures the rate of heating. Averages within 10% of baseline, in the illustration, indicate normal operation at 84 and when the average of a set drops below 0.9 (baseline) as a 86, a clean out condition is indicated and communicated as desired. If operation is normal, N is incremented at 88. Of course, any fraction or percentage decline desired may be selected to trigger an alert situation. The use of 0.9 (baseline) being reasonable, but purely arbitrary and selected for the sake of illustration.

This invention has been described herein in considerable detail in order to comply with the Patent Statutes and to provide those skilled in the art with the information needed to apply the novel principles and to construct and use embodiments of the example as required. However, it is to be understood that the invention can be carried out by specifically different devices and that various modifications can be accomplished without departing from the scope of the invention itself.

What is claimed is:

1. A condition alert system for a liquid heating system that determines deposit buildup on heat exchange surfaces based on a decline in reheat efficiency of the vessel, the system comprising:

(a) a heating vessel for containing a liquid of interest to be heated;

(b) a source of heat for heating a liquid of interest in the vessel;

(c) a heating controller for controlling the source of heat for reheating the liquid to a set point temperature;

(d) a temperature sensor for sensing the temperature of the liquid in the vessel;

(e) a timing device for noting the time interval required for reheating the liquid to set point temperature;

(f) a calculating device for determining a current reheat efficiency value based on an average rate of change of the temperature of the liquid to set point as a function of time over a number of reheat phases and comparing the current reheat efficiency value with a stored baseline reheat efficiency value noting any deviation therebetween; and (g) output device for providing an alert output signal when the deviation reflects a decrease in reheat efficiency that exceeds a predetermined amount.

2. A condition alert system as in claim 1 wherein the current reheat value is determined from an average of a set based on monitoring a predetermined number of reheat phase times.

3. A condition alert system as in claim 1 wherein said baseline reheat efficiency value is determined from an average of a set based on monitoring a predetermined number of reheat phase times that constitutes a startup set for the system.

4. A condition alert system as in claim 3 wherein the order and predetermined number of reheat cycle times defining a set is based on a programmable function stored in memory.

5. A condition alert system as in claim 4 wherein the reheat cycle times defining a set are consecutive.

6. A condition alert system as in claim 4 wherein the reheat cycle times are not consecutive.

7. A condition alert system as in claim 1 wherein said calculating device includes a microprocessor.

8. A condition alert system as in claim 7 wherein the predetermined number of reheat cycle times defining a set other than a first set is determined based, at least in part, on stored data from past monitoring history.

9. A condition alert system as in claim 7 wherein the order and predetermined number of reheat cycle times defining a set is based on a programmable function stored in memory.

10. A condition alert system as in claim 9 wherein the reheat cycle times are not consecutive.

11. A condition alert system as in claim 1 wherein the output device provides a visual signal to the user.

12. A condition alert system as in claim 1 wherein the output device provides a signal to a remote location.

13. A condition alert system as in claim 1 wherein the heating vessel is selected from the group consisting of boilers and water heaters.

14. A condition alert system as in claim 1 wherein the output device provides an audible signal to the user.

15. A method of determining a clean out condition in a liquid heating system in which periodic reheating to a set point maintains an elevated liquid temperature comprising the steps of:

(a) generating a baseline rate of liquid temperature rise value during reheat for the heating system;

(b) measuring the time required and temperature span to set point for a predetermined number of reheat phases for the liquid heating system to determine a current rate of temperature rise for each and an average rate of rise over the predetermined number of reheat phases to produce a current average value for a current set of reheat phases;

(c) comparing the current average value with a baseline value and noting a current deviation; and (d) when the deviation of a current average value exceeds a predetermined fraction of baseline, providing an output in the form of an alerting signal.

16. A method as in claim 15 wherein the baseline value is generated based on an initial current average.

17. A method as in claim 15 wherein the alerting signal is selected from the group consisting of audio and visual alerts to the user, remote signaling via computer and remote signal to a service company.

18. A method as in claim 15 wherein the number of reheat phases and sampling function is microprocessor controlled.

19. A method as in claim 18 wherein the number of reheat phase and sampling function changes with time.

20. A method as in claim 15 wherein the average value for a set is based on $\geqq 5$ consecutive reheat phases.

21. A condition alert system for a heating system for a liquid medium in which liquid is heated to a set point temperature during a heating phase of a heating cycle using a temperature responsive heat source, said condition alert system comprising:

(a) a temperature monitoring device for receiving signals indicative of the temperature of the liquid medium;

(b) a timing device for noting the time interval required for reheating the liquid to set point temperature;

(c) a calculating device for determining a current reheat efficiency value based on an average rate of change of the temperature of the liquid to set point as a function of time over a number of sampled reheat phases and comparing the current reheat efficiency value with a stored baseline reheat efficiency value noting any deviation therebetween; and (d) an output device for providing an alert output signal when the deviation reflects an increase in reheat time indicating a decrease in reheat efficiency that exceeds a predetermined amount.

22. A condition alert system as in claim 21 wherein said calculating device includes a microprocessor.

23. A condition alert system as in claim 21 wherein said temperature monitoring device includes a device for digitizing the data.

24. A condition alert system as in claim 21 wherein the sampling rate function is reprogrammable based on system history.

25. A condition alert system as in claim 24 wherein the sampling rate function is self-reprogrammable based on system history.

26. A condition alert system as in claim 21 wherein said output device provides a signal to the user selected from the group consisting of audible and visual signals.

27. A condition alert system as in claim 26 wherein said output device provides a visual signal.

28. A condition alert system as in claim 21 wherein said output device provides a signal to a remote location.

29. A condition alert system as in claim 21 wherein the current reheat efficiency value is determined from an average of a set of values based on monitoring a predetermined number of reheat phase times.

30. A condition alert system as in claim 21 wherein said baseline reheat value is determined from an average of a set based on monitoring a predetermined number of reheat phase times that constitutes a start up set for the system.

31. A condition alert system as in claim 21 wherein the reheat cycle times defining a set are consecutive.

32. A condition alert system as in claim 21 wherein the reheat cycle times defining a set are not consecutive.

* * * * *